US010906322B2

(12) United States Patent
Sakai et al.

(10) Patent No.: US 10,906,322 B2
(45) Date of Patent: Feb. 2, 2021

(54) LIQUID EJECTING APPARATUS

(71) Applicant: SEIKO EPSON CORPORATION, Tokyo (JP)

(72) Inventors: Nanami Sakai, Matsumoto (JP); Masato Haga, Shiojiri (JP); Masaki Shimomura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/511,264

(22) Filed: Jul. 15, 2019

(65) Prior Publication Data

US 2020/0023646 A1 Jan. 23, 2020

(30) Foreign Application Priority Data

Jul. 17, 2018 (JP) ..... 2018-134284

(51) Int. Cl.
*B41J 2/175* (2006.01)

(52) U.S. Cl.
CPC ..... *B41J 2/1752* (2013.01); *B41J 2/17523* (2013.01); *B41J 2002/17516* (2013.01)

(58) Field of Classification Search
CPC ..... B41J 2002/17516
See application file for complete search history.

(56) References Cited

U.S. PATENT DOCUMENTS 5,138,344 A * 8/1992 Ujita ..... B41J 2/17513 347/14
8,651,638 B2 * 2/2014 Ishikawa ..... B41J 2/17513 347/86

(Continued)

FOREIGN PATENT DOCUMENTS

JP 2005-288866 A 10/2005
JP 2006-116784 A 5/2006

(Continued)

OTHER PUBLICATIONS

Machine generated English translation of JP2017-185639 to Koizumi et al., "Cartridge, Printing Material Supply Device and Printer"; retrieved via https://worldwide.espacenet.com on Jun. 17, 2020; 33pp. (Year: 2020).*

(Continued)

*Primary Examiner* — Shelby L Fidler
(74) *Attorney, Agent, or Firm* — Workman Nydegger

(57) ABSTRACT

A liquid ejecting apparatus includes a container on which a liquid container is removably mounted, the container having an engaging portion, the liquid container containing a liquid and having a grip portion that is gripped by a user; an attachment portion into which the container is inserted in an attachment direction from an attachment port and to which the container is attached; and a liquid ejecting head that ejects the liquid supplied from the liquid container mounted at the container. The attachment portion has an engaged portion that is engaged with the engaging portion of the container in a process of pulling out the container from the attachment portion. The container causes the grip portion to be located on an outer side with respect to the attachment port when the container is in an engaged state in which the engaging portion engages with the engaged portion.

10 Claims, 13 Drawing Sheets

(56) References Cited

U.S. PATENT DOCUMENTS

| | | | | |
|---|---|---|---|---|
| 2007/0008366 | A1* | 1/2007 | Nojima | B41J 29/02 347/19 |
| 2008/0284810 | A1* | 11/2008 | Shimizu | B41J 2/17553 347/20 |
| 2009/0256892 | A1* | 10/2009 | Takeuchi | B41J 2/17513 347/86 |
| 2011/0057997 | A1* | 3/2011 | Takeuchi | B41J 2/17559 347/86 |
| 2014/0240411 | A1* | 8/2014 | Oya | B41J 2/1752 347/86 |
| 2015/0375513 | A1* | 12/2015 | Nishimura | B41J 2/17523 347/86 |
| 2018/0093486 | A1* | 4/2018 | Nukui | B41J 2/17503 |

FOREIGN PATENT DOCUMENTS

| | | | | |
|---|---|---|---|---|
| JP | 2007090646 | A | * | 4/2007 |
| JP | 2017-043086 | A | | 3/2017 |
| JP | 2017-185639 | A | | 10/2017 |

OTHER PUBLICATIONS

Machine generated English translation of JP2007-090646A to Otsuka, "Ink Pack", retrieved via https://worldwide.espacenet.com on Jun. 17, 2020; 17pp. (Year: 2020).*

* cited by examiner

LIQUID EJECTING APPARATUS

The present application is based on, and claims priority from JP Application Serial Number 2018-134284, filed Jul. 17, 2018, the disclosure of which is hereby incorporated by reference herein in its entirety.

BACKGROUND

1. Technical Field

The present disclosure relates to a liquid ejecting apparatus such as a printer.

2. Related Art

For example, JP-A-2017-43086 describes a printer as an example of a liquid ejecting apparatus. The printer includes a container that houses an ink pack filled with an ink that is an example of a liquid, and a container housing portion that is an example of an attachment portion that houses the container. The ink pack is housed in the container in a state in which an adapter is attached to the ink pack. The adapter side of the container is inserted into the container housing portion such that the adapter is located on the deep side with respect to the ink pack.

In a state in which a portion of the container is pulled out from the container housing portion, the adapter is located in the container housing portion, and hence replacement of the ink pack is difficult. Thus, the replacement of the ink pack is performed in a state in which the container is removed from the container housing portion and is troublesome work.

Such a problem possibly occurs, without being limited to the printer in which the container housing portion houses the container, in a liquid ejecting apparatus in which a container is attached to an attachment portion.

SUMMARY

According to an aspect of the present disclosure, a liquid ejecting apparatus that addresses the above-described problem includes a container on which a liquid container is removably mounted, the container having an engaging portion, the liquid container containing a liquid and having a grip portion that is gripped by a user; an attachment portion into which the container is inserted in an attachment direction from an attachment port and to which the container is attached; and a liquid ejecting head that ejects the liquid supplied from the liquid container mounted at the container. The attachment portion has an engaged portion that is engaged with the engaging portion of the container in a process of pulling out the container from the attachment portion. The container causes the grip portion to be located on an outer side with respect to the attachment port when the container is in an engaged state in which the engaging portion engages with the engaged portion and the engaging portion and the engaged portion are arranged next to each other in the attachment direction.

DESCRIPTION OF EXEMPLARY EMBODIMENTS

An embodiment of a liquid ejecting apparatus is described below with reference to the drawings. The liquid ejecting apparatus is, for example, an ink jet printer that performs printing by ejecting an ink, which is an example of a liquid, on a medium such as a sheet of paper.

Figure 1:
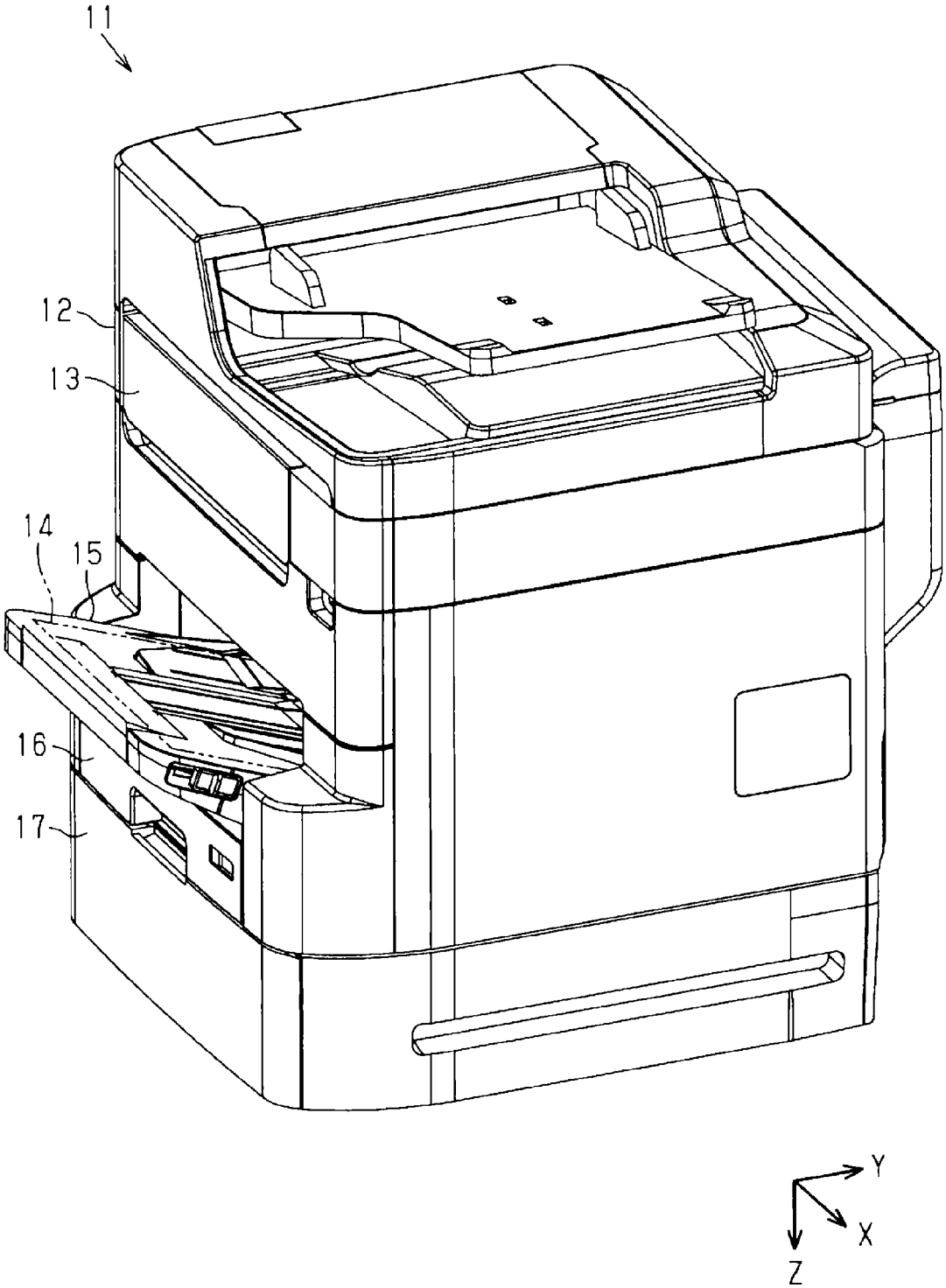
FIG. 1 is a perspective view of an embodiment of a liquid ejecting apparatus.

As illustrated in FIG. 1, a liquid ejecting apparatus 11 includes a substantially rectangular-parallelepiped exterior body 12. An operation section 13 for operating the liquid ejecting apparatus 11 is provided at a front surface at which an operation is mainly maid on the liquid ejecting apparatus 11 among side surfaces of the exterior body 12. An output tray 15 to which a medium 14 is output, a medium housing body 16 capable of housing the medium 14, and a pivotable cover 17 may be arranged below the operation section 13.

In the drawing, based on an assumption that the liquid ejecting apparatus 11 is placed on a horizontal plane, the Z axis indicates the direction of gravity and the X axis and Y axis indicate directions along a plane intersecting with the Z axis. When the X axis, Y axis, and Z axis are orthogonal to one another, the X axis and Y axis extend along the horizontal plane. In the following description, the direction indicated by the X axis is also referred to as a width direction X, the direction indicated by the Y axis is also referred to as a depth direction Y, and the direction indicated by the Z axis is also referred to as a vertical direction Z.

Figure 2:
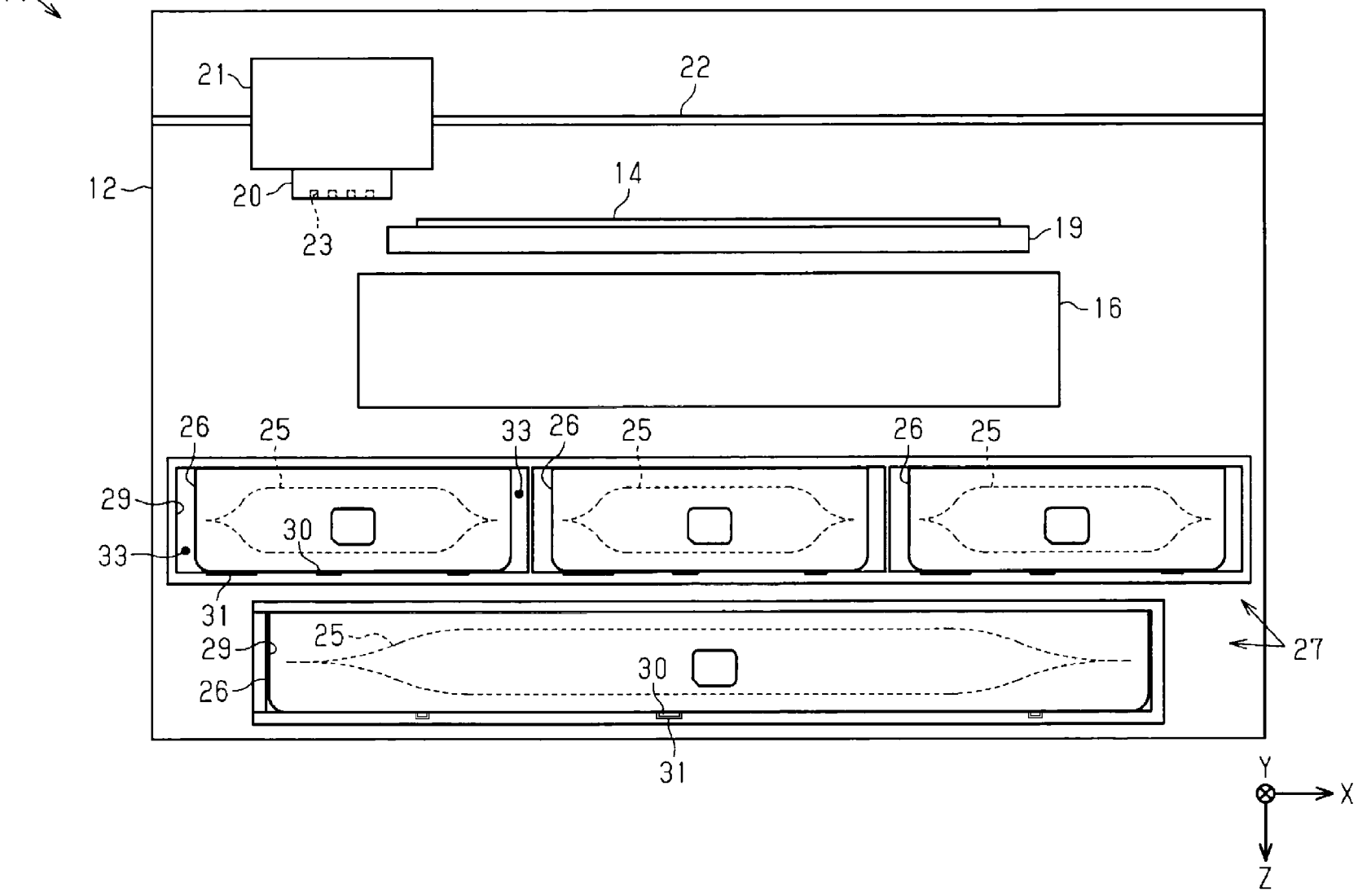
FIG. 2 is a schematic illustration of an inner configuration of the liquid ejecting apparatus.

As illustrated in FIG. 2, the liquid ejecting apparatus 11 includes a medium support 19 that supports a medium 14, a liquid ejecting head 20 that ejects a liquid, a carriage 21 that holds the liquid ejecting head 20 and reciprocates in the width direction X, and a guide shaft 22 that guides the movement of the carriage 21. The liquid ejecting head 20 has a nozzle 23 capable of ejecting the liquid. The liquid ejecting head 20 performs printing by ejecting the liquid toward the medium 14 supported by the medium support 19 while moving together with the carriage 21.

The liquid ejecting apparatus 11 includes a container 26 at which a liquid container 25 that houses a liquid is mounted, and an attachment portion 27 to which the container 26 is detachably attached. The liquid ejecting apparatus 11 may include a plurality of attachment portions 27. One or a plurality of containers 26 are attached to the attachment portion 27. For example, one container 26 having a large size in the width direction X may be attached to lower one of the attachment portions 27. Three containers 26 each having a small size in the width direction X may be arranged next to one another and attached to upper one of the attachment portions 27.

When the liquid ejecting apparatus 11 includes the plurality of containers 26, a plurality of liquid housing bodies 25 mounted at the containers 26 may house liquids of different types. The liquids of different types may be, for example, inks of different colors, such as black, cyan, magenta, and yellow.

The container 26 is inserted from an attachment port 29 into the attachment portion 27, is pushed in the depth direction Y, and is attached to the attachment portion 27. The attachment portion 27 may have a second guide 30 that guides the movement of the container 26 when the container 26 is attached or detached. For example, the second guide 30 is one or a plurality of protruding threads or recessed threads extending in the depth direction Y. A rail 31 that extends along a protrusion or a recess of the second guide 30 may be provided at a bottom surface of the container 26. The second guide 30 guides the engaged rail 31, and hence guides the container 26 that is attached to the attachment portion 27, and the container 26 that is pulled out from the attachment portion 27.

The container 26 and the liquid container 25 are attached to the attachment portion 27 in an attachment posture in which the size in the vertical direction Z is larger than the size in the width direction X. The size of the attachment portion 27 in the width direction X may be larger than the size of the container 26 in the attachment posture. A first gap 33 may be provided between the attachment portion 27 and the container 26 attached to the attachment portion 27 in the width direction X. The first gap 33 may be provided on each of both sides of the container 26 in the width direction X.

Figure 3:
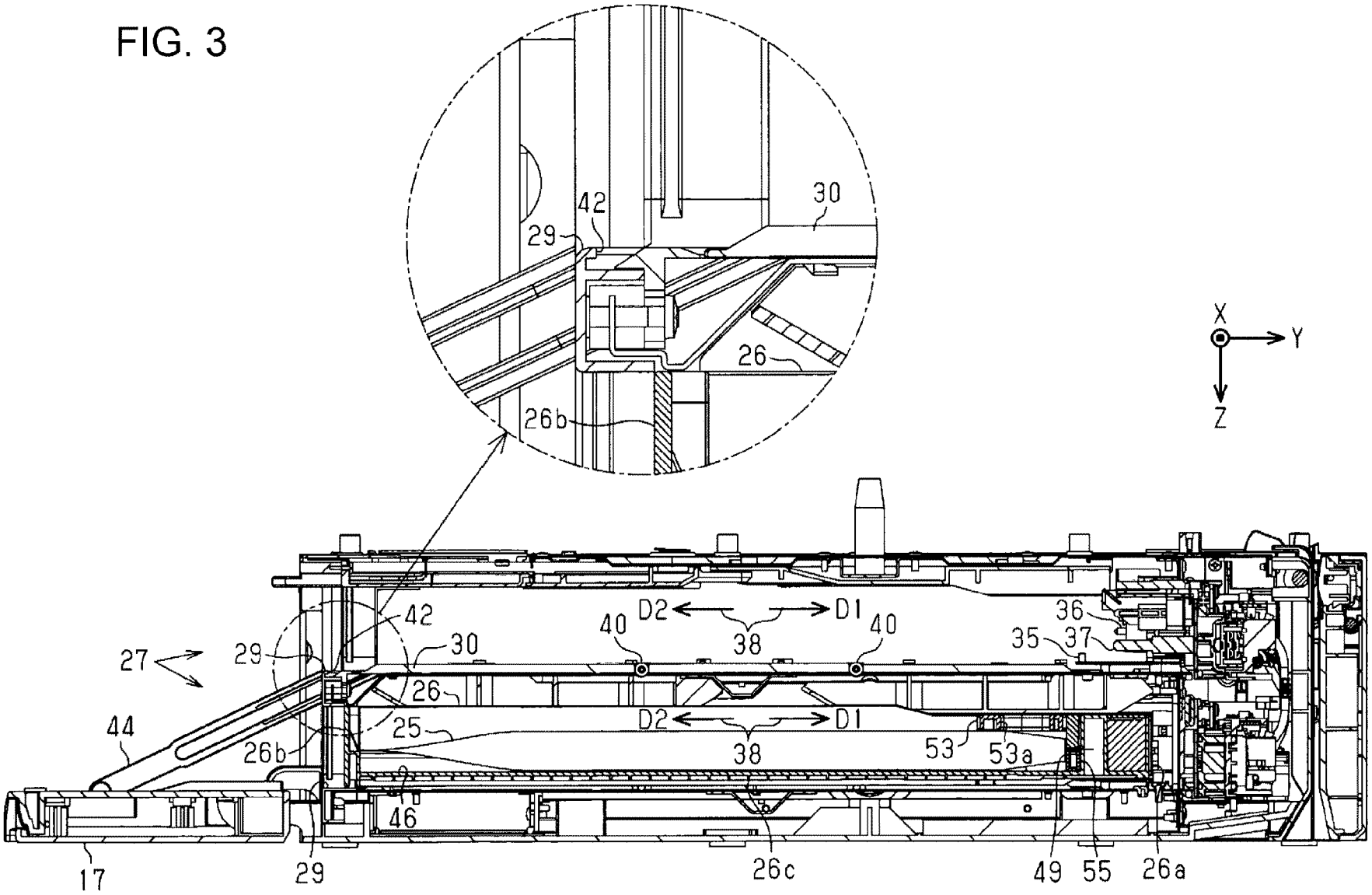
FIG. 3 is a cross-sectional view of an attachment portion.

As illustrated in FIG. 3, a retaining portion 35 capable of retaining the container 26, a hollow needle-shaped coupling portion 36, and a rod-shaped positioning protrusion 37 that positions the container 26 may be provided on the deep side of the attachment portion 27. The liquid ejecting apparatus 11 includes a number of coupling portions 36, the number being the same as the number of the containers 26 that can be attached to the attachment portion 27. The attachment portion 27 has a movement path 38 extending from the attachment port 29 to the coupling portion 36.

In the movement path 38, the direction from the attachment port 29 toward the coupling portion 36 is indicated as an attachment direction D1, and the direction from the coupling portion 36 toward the attachment port 29 is indicated as a pull-out direction D2 opposite to the attachment direction D1. The attachment direction D1 in this embodiment agrees with the depth direction Y, and intersects with the width direction X and the vertical direction Z. The container 26 is inserted in the attachment direction D1 from the attachment port 29 into the attachment portion 27 and is attached to the attachment portion 27. The container 26 attached to the attachment portion 27 is pulled out in the pull-out direction D2. The attachment portion 27 may include a roller bearing 40 for allowing the container 26 that is attached to or detached from the attachment portion 27 to easily move.

When the container 26 is attached to the attachment portion 27, the liquid container 25 mounted at the container 26 is coupled to the coupling portion 36. The liquid housed in the liquid container 25 is supplied to the liquid ejecting head 20 via the coupling portion 36. That is, the liquid ejecting head 20 ejects the liquid supplied from the liquid container 25 mounted at the container 26.

The upper attachment portion 27 has an engaged portion 42 arranged next to the attachment port 29 in the attachment direction D1. The engaged portion 42 is located on the deep side with respect to the attachment port 29, and is provided in the movement path 38 of the container 26 that is pulled out from the attachment portion 27. The engaged portion 42 is a recessed portion recessed in the vertical direction Z.

The liquid ejecting apparatus 11 may include an arm 44 that determines the pivot range of the cover 17. The cover 17 is located at a closing position illustrated in FIG. 1, and an opening position illustrated in FIG. 3. The cover 17 located at the closing position covers the attachment port 29. The cover 17 located at the opening position exposes the attachment port 29.

An embodiment of the liquid container 25 and the container 26 is described next.

The drawings illustrate the X axis, Y axis, and Z axis in an attachment posture when the container 26 and the liquid container 25 are attached to the attachment portion 27.

As illustrated in FIG. 3, the container 26 in the attachment posture has a mount surface 46 at which the liquid container 25 is mounted, and the mount surface 46 extends along the X axis and Y axis.

Figure 4:
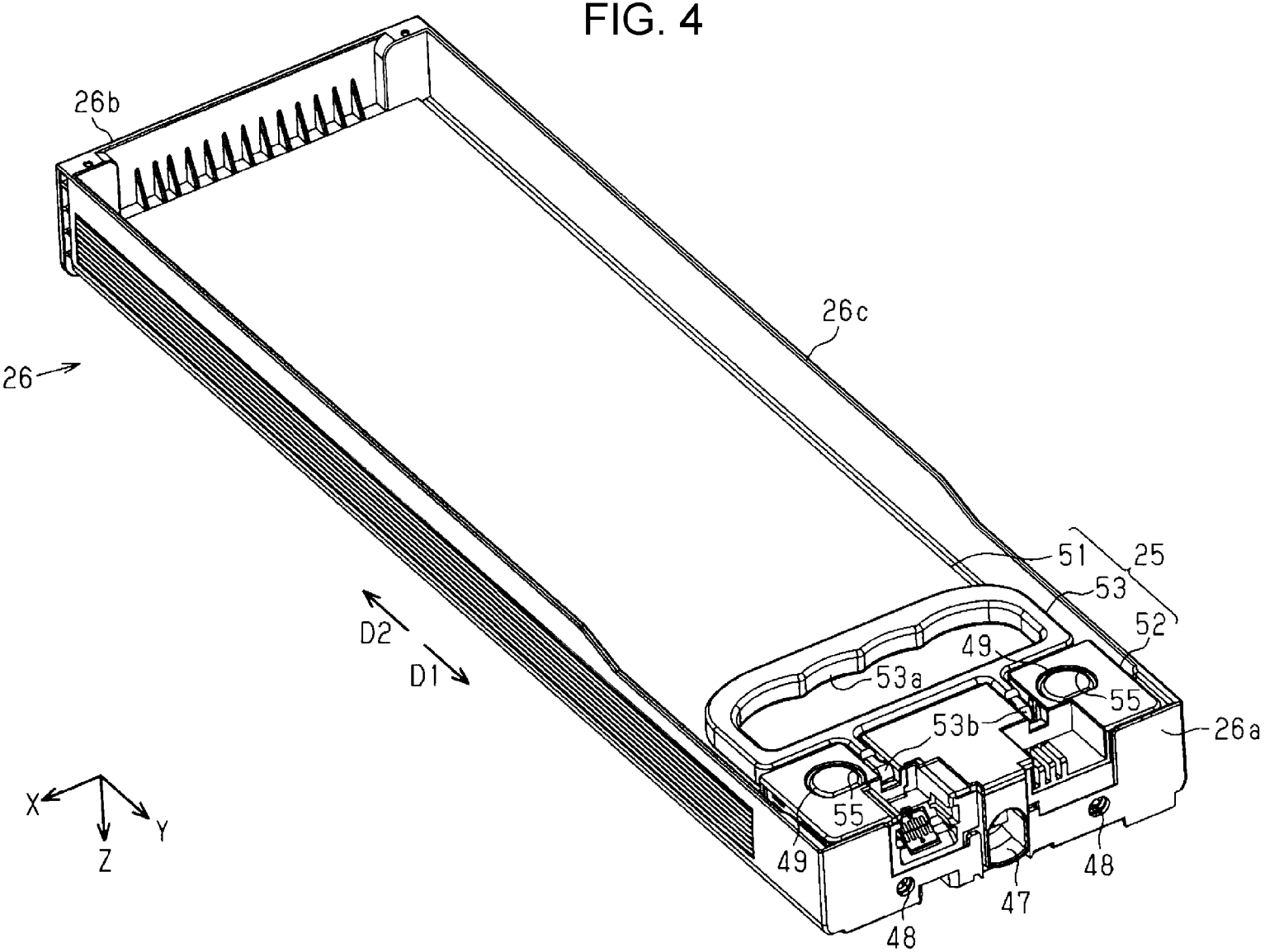
FIG. 4 is a perspective view of a container on which a liquid container is mounted.

As illustrated in FIG. 4, the container 26 has a substantially rectangular-parallelepiped external shape, and is open upward in the vertical direction Z. The container 26 has a leading end 26*a* that advances first when the container 26 is attached to the attachment portion 27, and a trailing end 26*b* opposite to the leading end 26*a*. The leading end 26*a* has formed therein a supply port 47 and a positioning hole 48. The supply port 47 is coupled to the coupling portion 36 and supplies the liquid, and the positioning hole 48 engages with the positioning protrusion 37 when the container 26 is attached to the attachment portion 27.

The container 26 may have one or a plurality of first guides 49 that guide the liquid container 25 when the liquid container 25 is removed from the container 26. In this embodiment, two first guides 49 are provided at positions between center 26*c* and the leading end 26*a* in the attachment direction D1, at an interval in the width direction X.

The liquid container 25 includes a bag 51 capable of housing a liquid, a supply portion 52 for supplying the liquid housed in the bag 51 to the liquid ejecting apparatus 11, and a handle 53 provided at the supply portion 52. The bag 51 is formed by stacking two rectangular film members and joining the four sides of the film members. The supply portion 52 is attached to a short side of the bag 51.

The handle 53 may be constituted of a member that differs from the supply portion 52. The handle 53 has a grip portion 53*a* that is gripped by a user when the liquid container 25 is mounted at or removed from the container 26. The grip portion 53*a* of the handle 53 becomes easily gripped when the grip portion 53*a* is pivotable around a pivot shaft 53*b*. The grip portion 53*a* is located nearer to a trailing end 26*b* than the pivot shaft 53*b*.

The supply portion 52 has a guided portion 55 formed through the supply portion 52 in the vertical direction Z. In this case, two guided portions 55, two being the same as the number of the first guides 49 of the container 26, are provided. The two guided portions 55 are provided at positions on both sides of the pivot shafts 53*b* in the width direction X, so as to be arranged in line with the pivot shafts 53*b*.

As illustrated in FIGS. 3 and 4, the first guide 49 has a substantially circular columnar shape, and protrudes upward in the vertical direction Z from the mount surface 46 in the attachment posture. The guided portion 55 that is guided by the first guide 49 has a substantially circular hole shape. The first guide 49 guides the guided portion 55 and hence guides the liquid container 25 that is mounted at and removed from the container 26.

Figure 5:
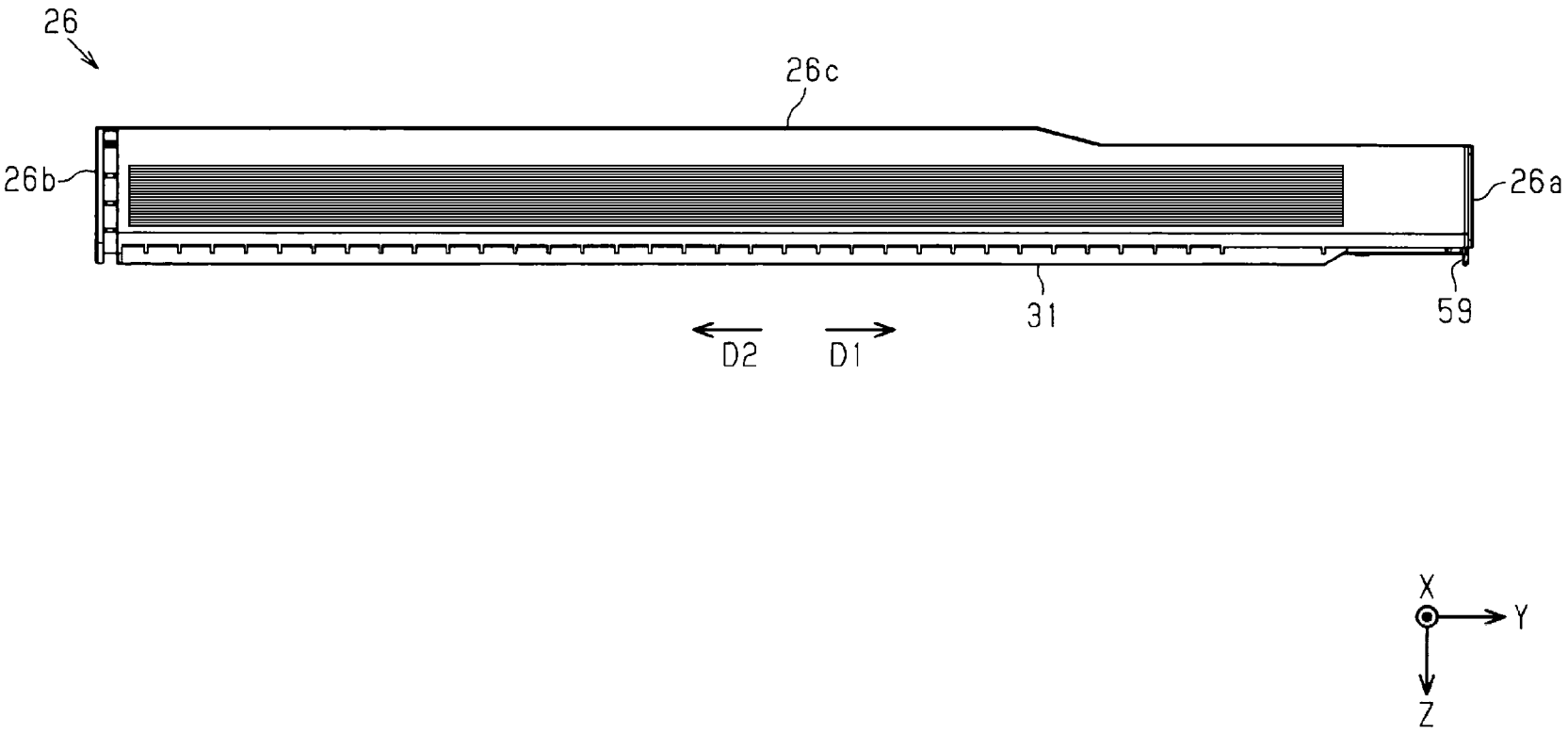
FIG. 5 is a side view of the container.

As illustrated in FIG. 5, the container 26 has a step between the center 26*c* and the leading end 26*a* in the depth direction Y, and the leading end 26*a* is lower than the center 26*c*. Thus, regarding the size of the container 26 in the vertical direction Z, the size at the leading end 26*a* is smaller than the size at the center 26*c* and the size at the trailing end 26*b*.

Figure 6:
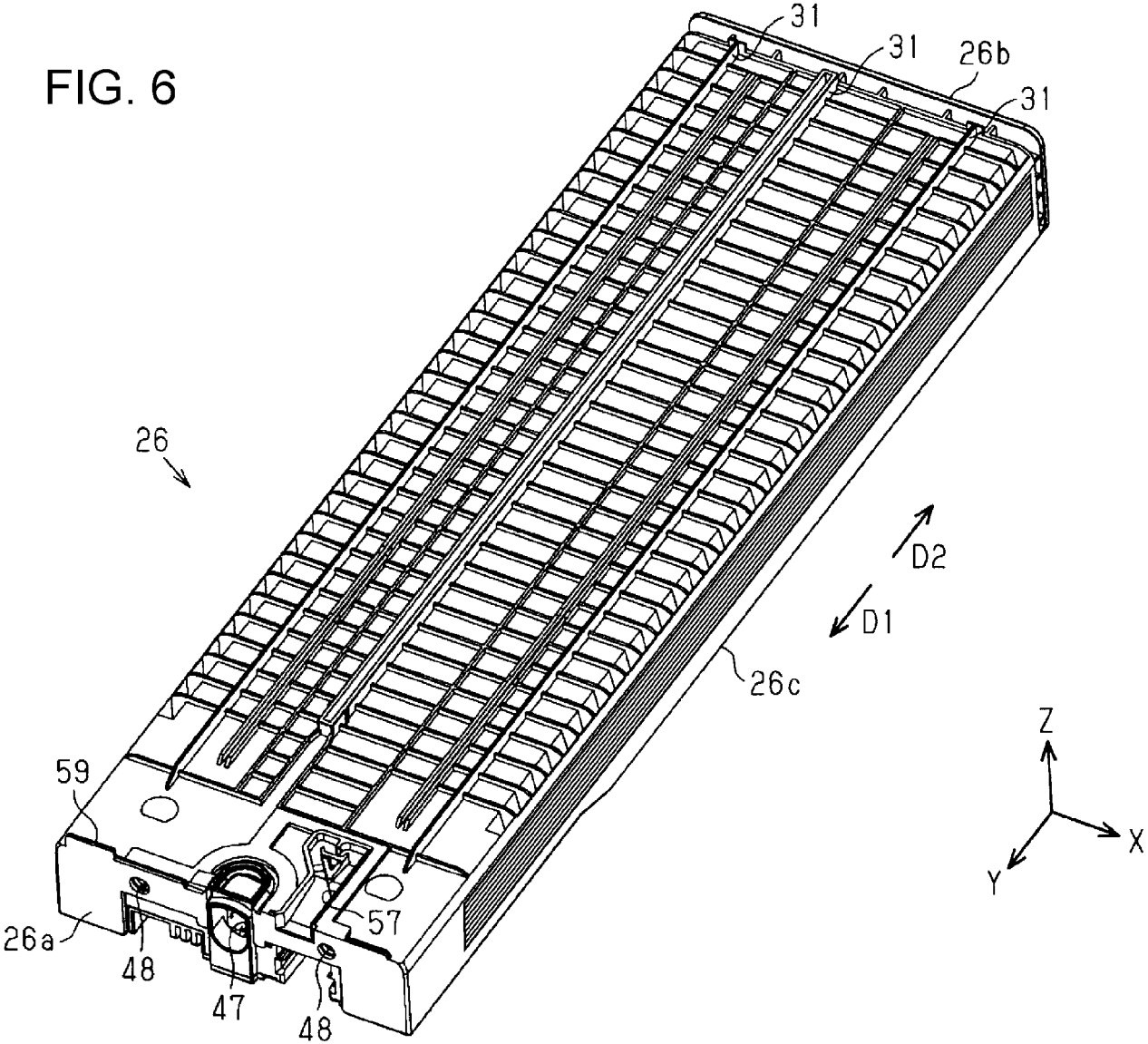
FIG. 6 is a perspective view from a bottom surface of the container.
Figure 7:
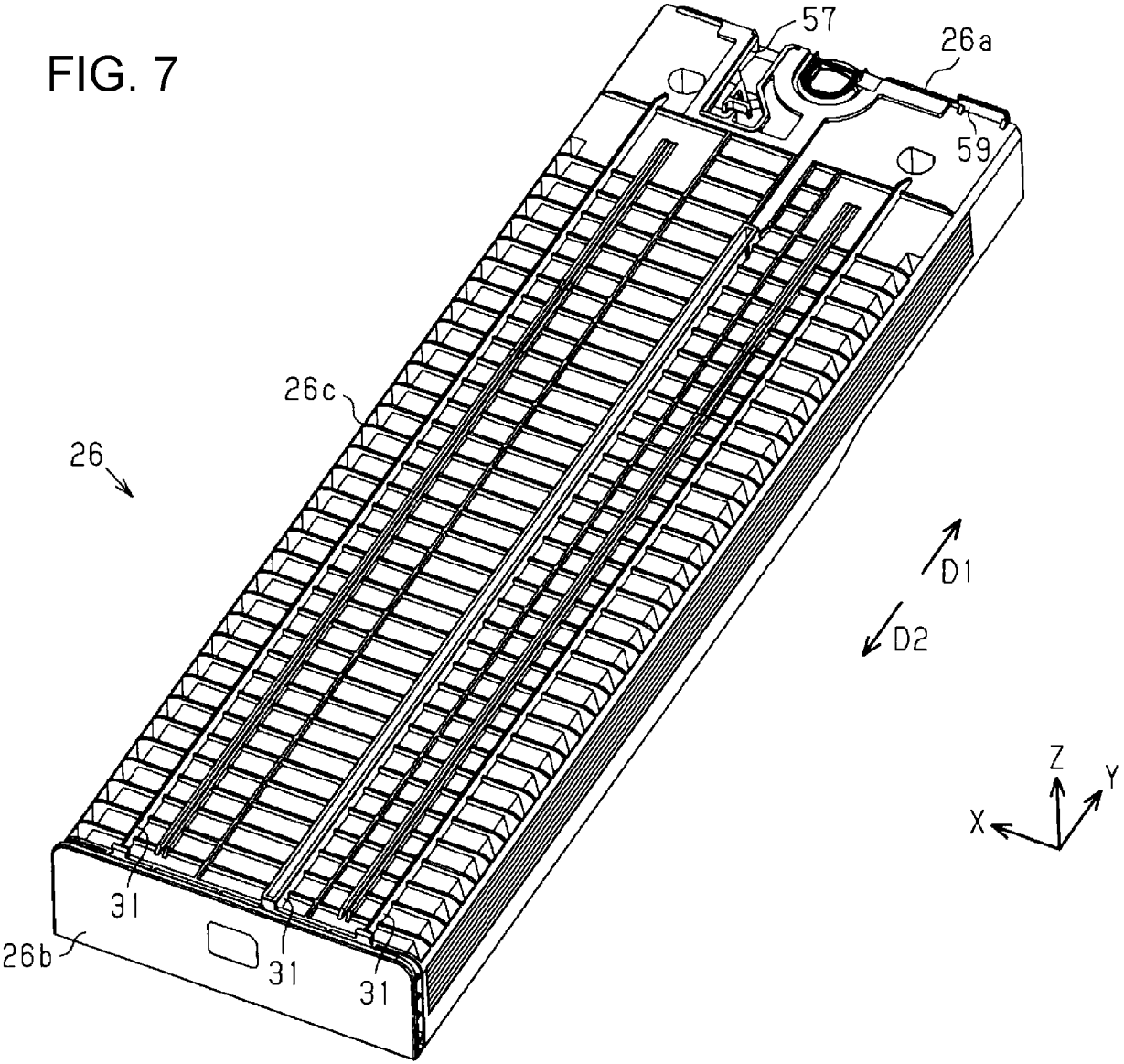
FIG. 7 is a perspective view from the bottom surface of the container.
Figure 8:
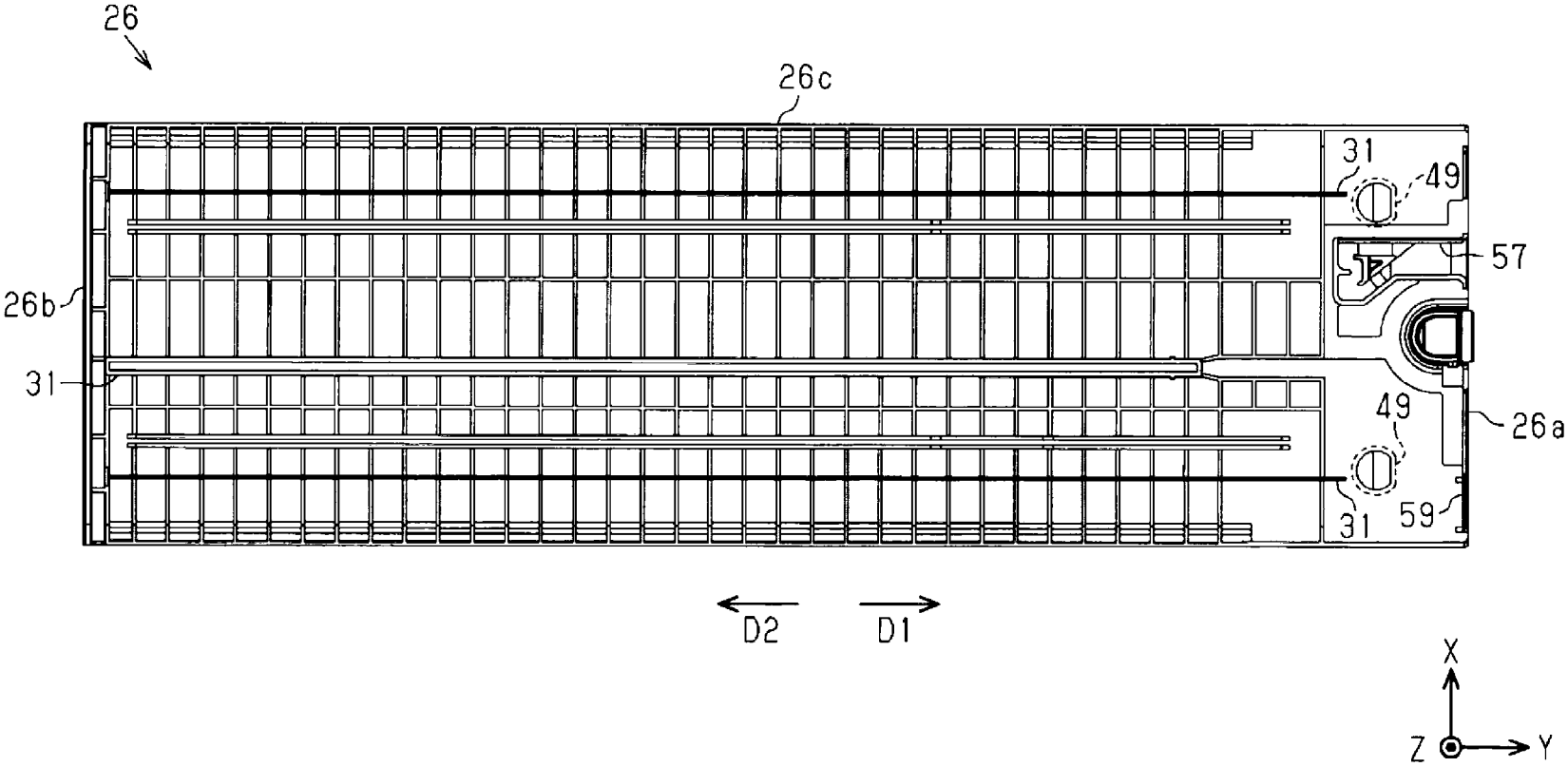
FIG. 8 is a bottom view of the container.

As illustrated in FIGS. 6 through 8, an engagement recessed portion 57 capable of engaging with the retaining portion 35 at attachment to the attachment portion 27 may be provided at the bottom surface of the container 26. The engagement recessed portion 57 may have, for example, a heart cam shape.

The container 26 includes an engaging portion 59 that is located nearer to the leading end 26*a* than the center 26*c* of the container 26 in the attachment direction D1. The engaging portion 59 is formed to protrude downward in the vertical direction Z from the bottom surface of the container 26. The engaging portion 59 is a protruding portion that is engaged with the engaged portion 42 in a process of pulling out the container 26 from the attachment portion 27. The engaging portion 59 may be located between the rail 31 and the leading end 26*a*. The engaging portion 59 may be located between the leading end 26*a* and the first guide 49 in the attachment direction D1.

Figure 9:
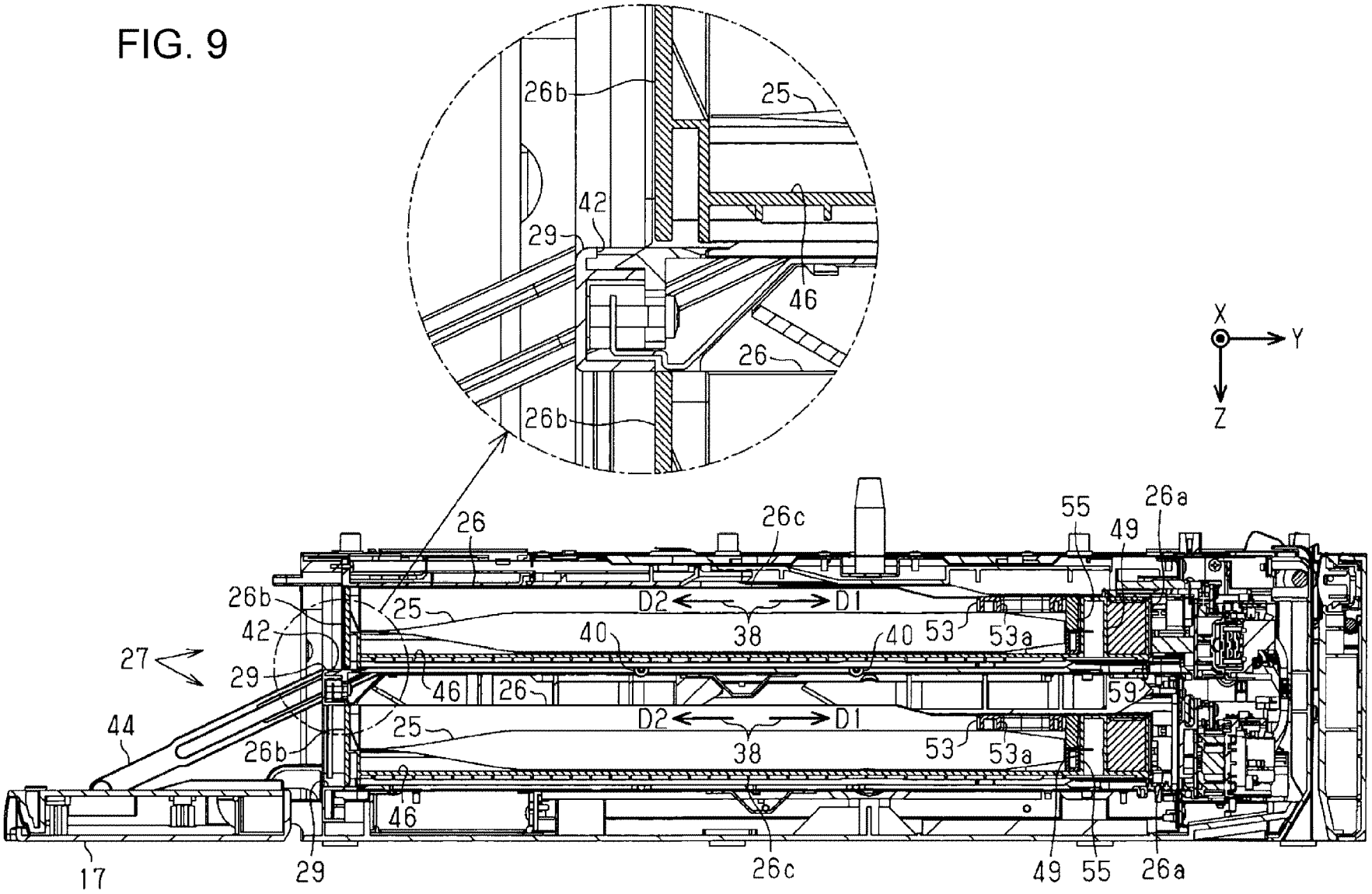
FIG. 9 is a cross-sectional view of the attachment portion to which the container is attached.

As illustrated in FIG. 9, the leading end 26*a* of the container 26 in the attachment direction D1 is inserted first into the attachment portion 27. The engaged portion 42 is located nearer to the attachment port 29 than the center 26*c* of the container 26 attached to the attachment portion 27. Thus, the engaged portion 42 is located nearer to the attachment port 29 than the engaging portion 59 in the state in which the container 26 is attached to the attachment portion 27.

Figure 10:
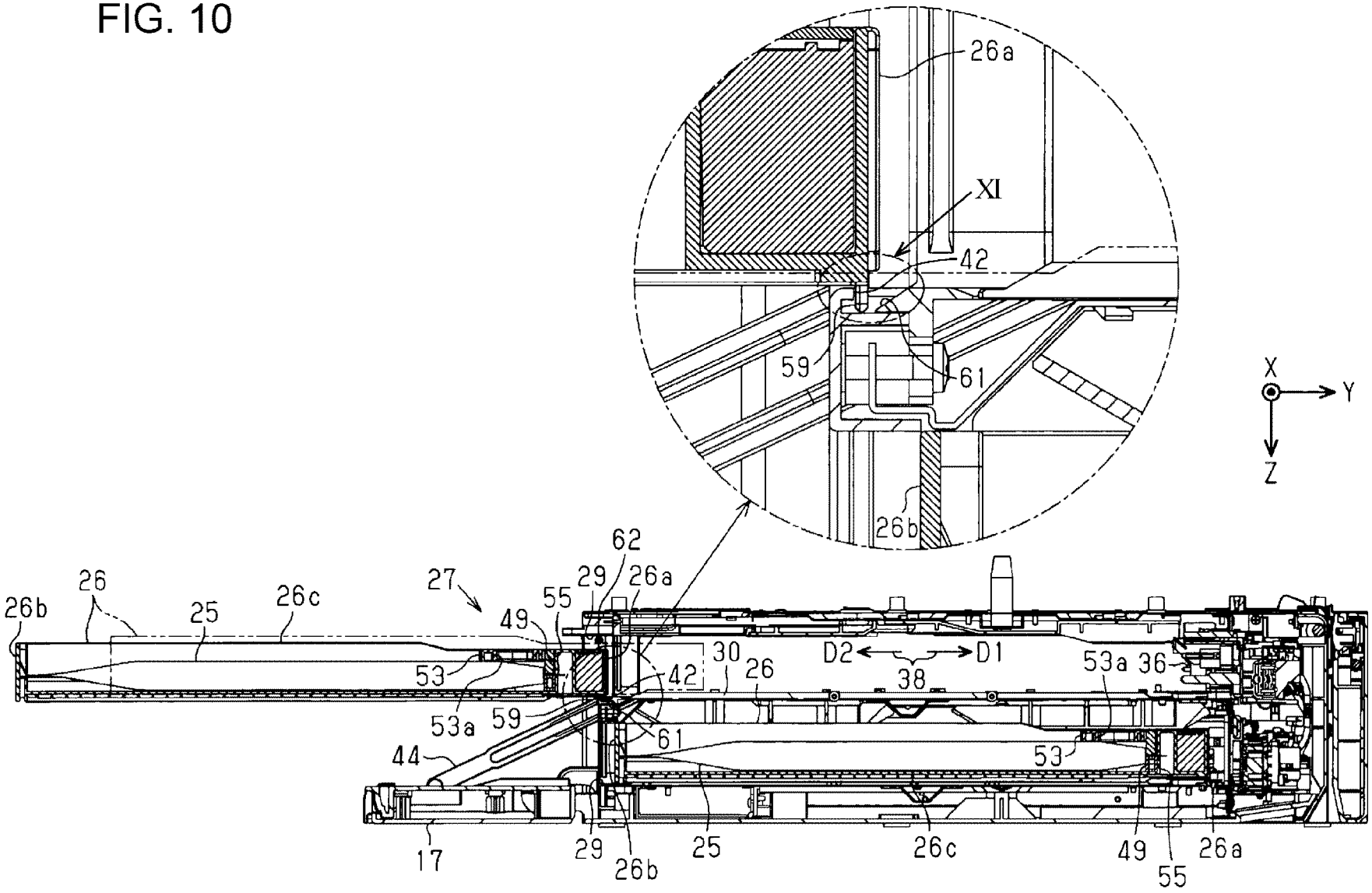
FIG. 10 is a cross-sectional view of the container and the attachment portion in an engaged state.
Figure 11:
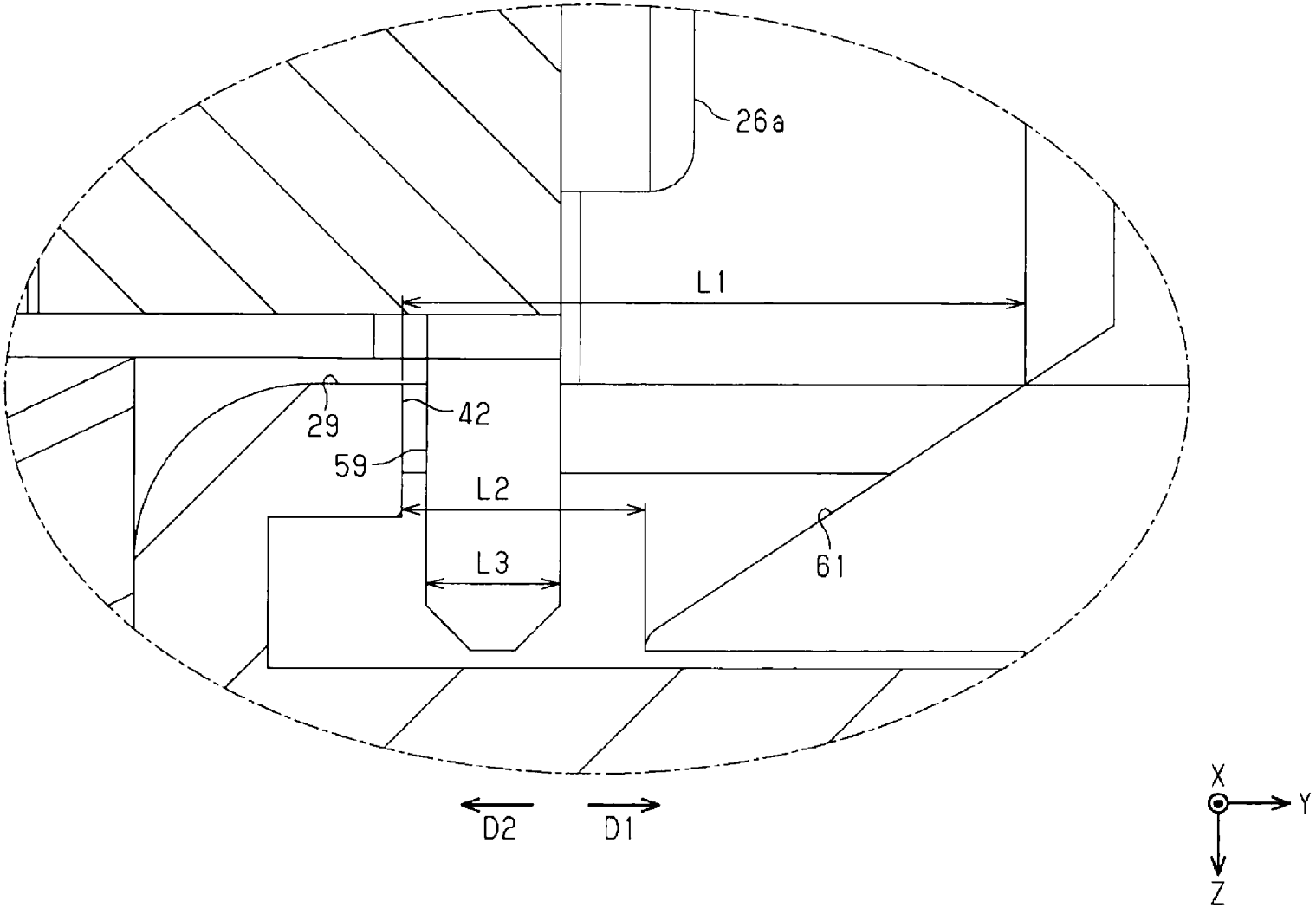
FIG. 11 is an enlarged view of an area XI in FIG. 10.

As illustrated in FIGS. 10 and 11, the engaged portion 42 engages with the engaging portion 59 of the container 26 in the process of pulling out the container 26 from the attachment portion 27. An end of the second guide 30 near the attachment port 29 is located on the deep side with respect to the engaged portion 42. In other words, the engaged portion 42 is located between the second guide 30 and the attachment port 29 in the attachment direction D1. A surface located on the deep side in the attachment direction D1 among surfaces constituting the engaged portion 42 has an inclined portion 61 inclined downward from the deep side toward the attachment port 29.

Regarding the size of the container 26 in the vertical direction Z, the size at the portion provided with the engaging portion 59 is smaller than the size at the center 26*c*. The engaging portion 59 descends the inclined portion 61 and engages with the engaged portion 42. Hence, the container 26 in the engaged state is located at the position lower in the vertical direction Z than the position in the state indicated by two-dot chain lines in FIG. 10 before the engaging portion 59 engages with the engaged portion 42. That is, in the engaged state, a second gap 62 is generated between the container 26 and the attachment portion 27 in the vertical direction Z. The container 26 can change its posture such that the trailing end 26*b* moves in the vertical direction Z while being kept in the engaged state in which the engaging portion 59 near the leading end 26*a* engages with the engaged portion 42.

Figure 12:
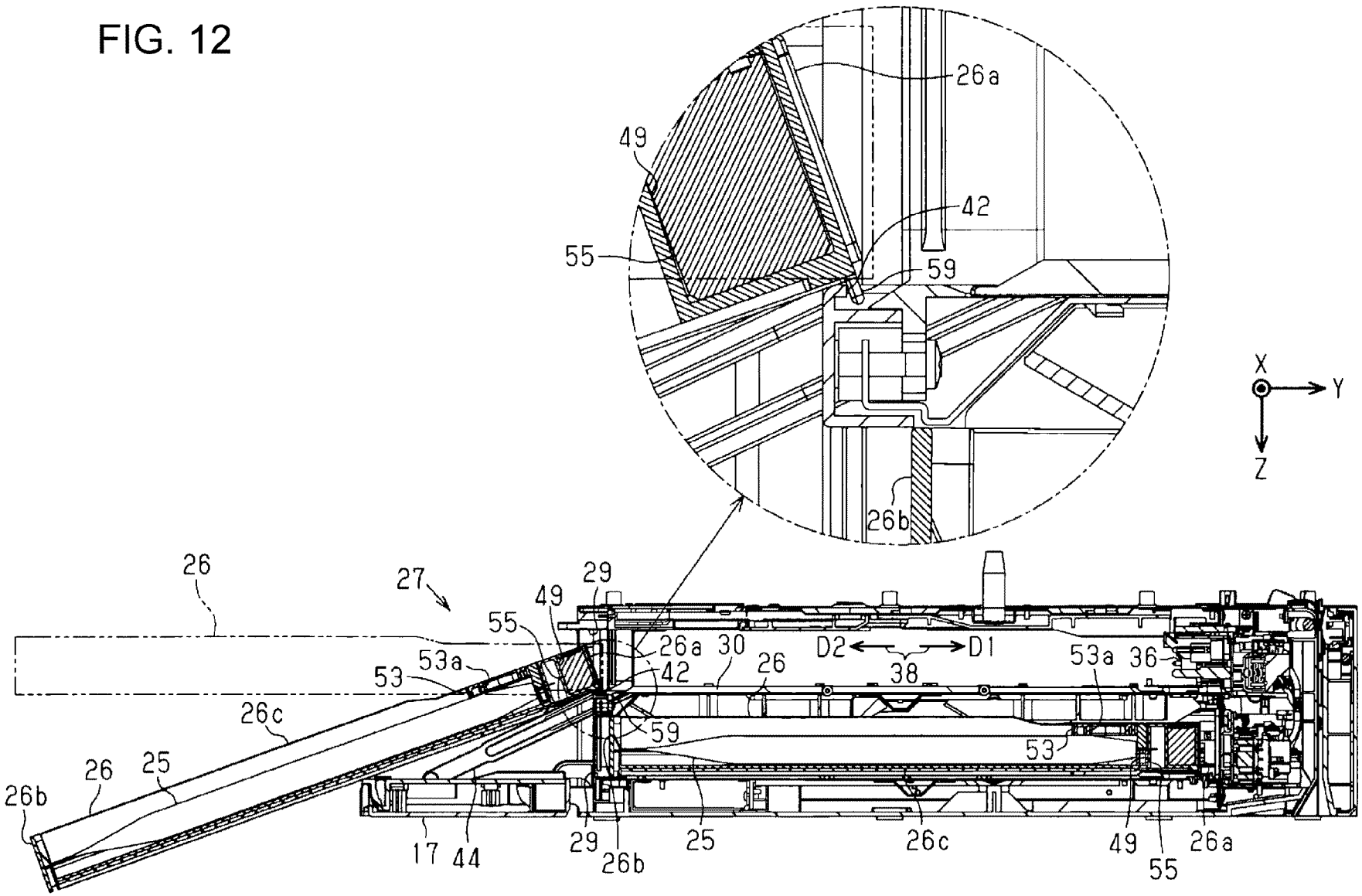
FIG. 12 is a cross-sectional view of the container and the attachment portion in the engaged state.

As illustrated in FIG. 12, the container 26 in the engaged state contacts the cover 17 located at the opening position. The cover 17 may be provided with a support that supports the container 26 contacting the cover 17 while the container 26 is kept in the engaged state.

As illustrated in FIG. 11, a first length L1 of the engaged portion 42 in the attachment direction D1 and a second length L2 of the bottom surface of the engaged portion 42 in the attachment direction D1 may be larger than a third length L3 of the engaging portion 59 in the attachment direction D1. The length of the engaged portion 42 in the width direction X may be larger than the length of the engaging portion 59 in the width direction X.

Figure 13:
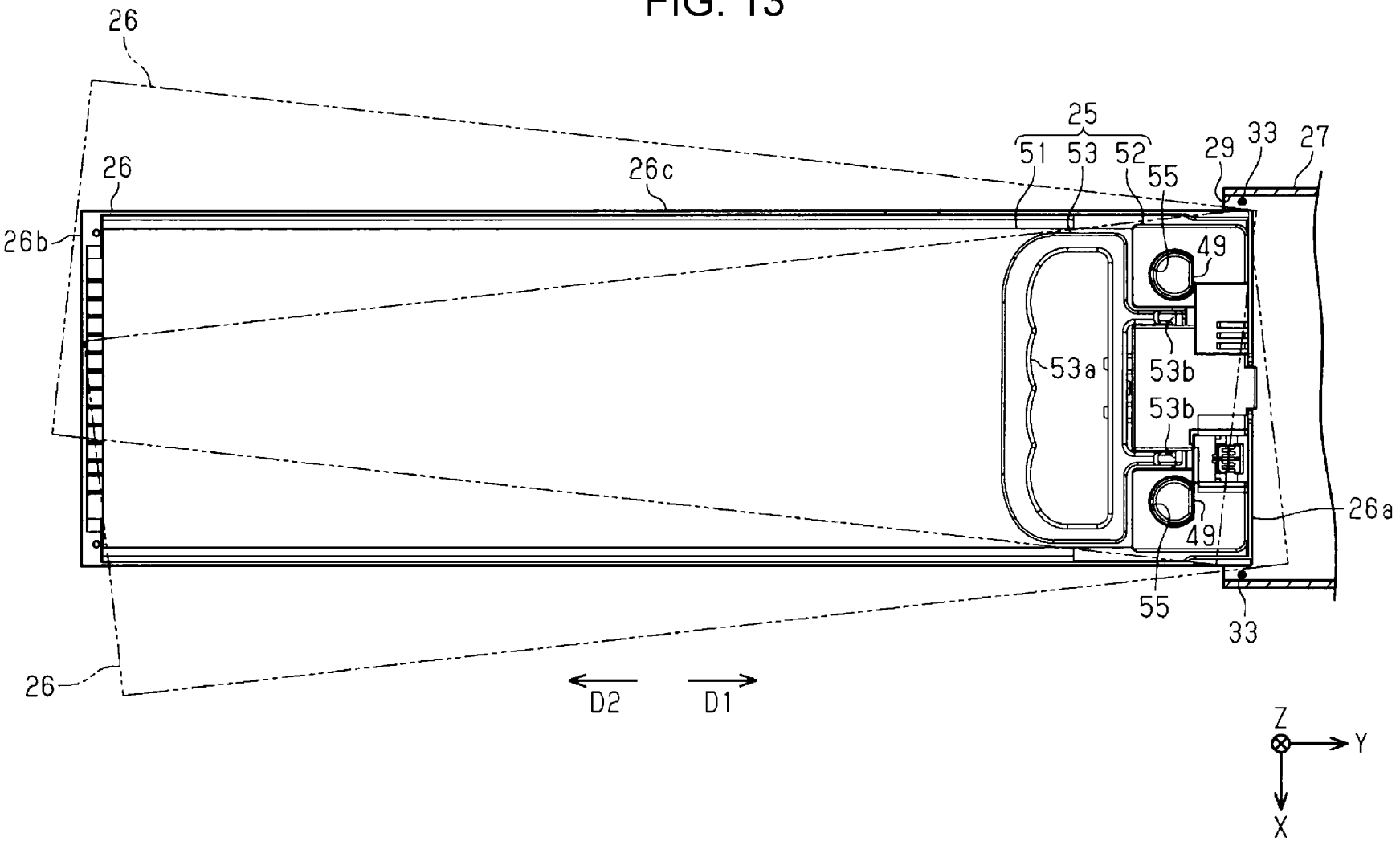
FIG. 13 is a plan view of the container in the engaged state.

As illustrated in FIG. 13, the first gap 33 is provided between the container 26 and the attachment portion 27 in the width direction X. In addition, as illustrated in FIG. 11, the second length L2 of the bottom surface of the engaged portion 42 in the attachment direction D1 is larger than the third length L3 of the engaging portion 59 in the attachment direction D1. Thus, the container 26 in the engaged state can change its posture such that the trailing end 26*b* moves in the width direction X while being kept in the engaged state in which the engaging portion 59 near the leading end 26*a* engages with the engaged portion 42.

An operation of this embodiment is described.

As illustrated in FIG. 3, when the container 26 is attached to the attachment portion 27, the cover 17 located at the closing position is pivoted by about 90 degrees to the opening position. In this state, the leading end 26*a* of the container 26 in the attachment direction D1 is inserted first into the attachment portion 27.

As illustrated in FIG. 10, when the engaging portion 59 falls into the engaged portion 42 in the process of attaching the container 26 to the attachment portion 27, the engaging portion 59 passes through the engaged portion 42 so as to ascend the inclined portion 61.

As illustrated in FIG. 9, the container 26 is pushed in the attachment direction D1 until the liquid container 25 is coupled to the coupling portion 36. When the liquid container 25 is replaced, the user pulls out the container 26 attached to the attachment portion 27 in the pull-out direction D2.

As illustrated in FIG. 10, the engaging portion 59 engages with the engaged portion 42 after the guide by the second guide 30 is removed in the process of pulling out the container 26 from the attachment portion 27. In the engaged state in which the engaging portion 59 engages with the engaged portion 42, the engaging portion 59 is located on the deep side with respect to the engaged portion 42, and the engaging portion 59 and the engaged portion 42 are arranged next to each other in the attachment direction D1. In the engaged state, the container 26 causes the grip portion 53*a* to be located on the outer side with respect to the attachment port 29. In this case, the pivot shaft 53*b* and the first guide 49 of the container 26 may be also located on the outer side with respect to the attachment port 29.

The container 26 can be inclined in the vertical direction Z or the width direction X and can cause the cover 17 to support the container 26 while being kept in the engaged state. The liquid container 25 can be removed from the container 26 in the engaged state or can be replaced.

Advantageous effects of this embodiment are described.

(1) In the engaged state, since the engaging portion 59 and the engaged portion 42 are arranged next to each other in the attachment direction D1, a portion of the container 26 is located in the attachment portion 27. The container 26 in the engaged state causes the grip portion 53*a* of the liquid container 25 to be located on the outer side with respect to the attachment port 29. Accordingly, the user can grip the grip portion 53*a* in a state in which a portion of the container 26 is located in the attachment portion 27. Thus, the liquid container 25 can be easily removed from the container 26.

(2) When the container 26 is in the engaged state, the first guide 49 is located on the outer side with respect to the attachment port 29. Accordingly, the user can remove the liquid container 25 while watching at the first guide 49. Thus, even when the container 26 includes the first guide 49, the liquid container 25 can be easily removed from the container 26.

(3) The engaging portion 59 is located nearer to the leading end 26*a* than the center 26*c* of the container 26, and the engaged portion 42 is located nearer to the attachment port 29 than the center 26*c* of the container 26. The size of the container 26 at the leading end 26*a* is smaller than the size of the container 26 at the center 26*c*. Accordingly, the container 26 can be inclined such that the trailing end 26*b* opposite to the leading end 26*a* moves in the vertical direction Z while being kept in the engaged state, and the liquid container 25 can be more easily removed from the container 26.

(4) The first gap 33 is provided between the attachment portion 27 and the container 26 attached to the attachment portion 27 in the width direction X. However, since the attachment portion 27 has the second guide 30 that guides the container 26, the container 26 can be stably moved. After the guide of the container 26 by the second guide 30 is removed, the engaging portion 59 engages with the engaged portion 42. Accordingly, when the container 26 is in the engaged state, the second guide 30 does not guide the container 26. Since the first gap 33 is provided between the container 26 and the attachment portion 27, the container 26 can be inclined such that the trailing end 26*b* opposite to the leading end 26*a* moves in the width direction X while being kept in the engaged state, and the liquid container 25 can be further easily removed from the container 26.

(5) The engaged portion 42 is the recessed portion recessed in the vertical direction Z. Accordingly, since the engaging portion 59 falls into the engaged portion 42 and engages with the engaged portion 42, the second gap 62 located at the upper position in the vertical direction Z between the attachment portion 27 and the container 26 in the engaged state increases. Thus, the container 26 in the engaged state can be easily inclined such that the trailing end 26*b* that is pulled out first is located at the position lower than the leading end 26*a* in the vertical direction Z.

(6) The length of the engaged portion 42, which is the recessed portion, in the attachment direction D1 is larger than the length of the engaging portion 59, which is the protruding portion, in the attachment direction D1. Since the first gap 33 is provided between the container 26 and the attachment portion 27 in the width direction X, the container 26 can be inclined such that the trailing end 26*b* opposite to the leading end 26*a* moves in the width direction X while being kept in the engaged state, and the liquid container 25 can be further easily removed from the container 26.

(7) The surface located on the deep side of the engaged portion 42 has the inclined portion 61 inclined downward from the deep side toward the attachment port 29. Accordingly, when the container 26 attached to the attachment portion 27 is pulled out, the engaging portion 59 is led by the engaged portion 42 along the inclined portion 61, and the engaging portion 59 can smoothly engage with the engaged portion 42.

(8) The engaged portion 42 is arranged next to the attachment port 29 in the attachment direction D1, and the engaging portion 59 is located between the leading end 26*a* and the first guide 49. Thus, when the container 26 is in the engaged state, the first guide 49 can be easily located on the outer side with respect to the attachment port 29.

(9) The container 26 in the engaged state contacts the cover 17 at the opening position. That is, since the container 26 is supported by the engaged portion 42 and the cover 17, the posture of the container 26 can be stable.

(10) When the trailing end 26*b* of the container 26 is gripped and the container 26 is pulled out from the attachment portion 27, the leading end 26*a* of the container 26 may fall. For example, when the container 26 attached to the upper attachment portion 27 falls in a state in which the container 26 attached to the lower attachment portion 27 is pulled out, the falling container 26 may hit the lower liquid container 25. In contrast, regarding the container 26 to be pulled out in the pull-out direction D2, the engaging portion 59 engages with the engaged portion 42 and the container 26 stops. Hence, the likelihood of the fall of the container 26 can be decreased.

This embodiment can be modified and implemented as follows. This embodiment and the following modifications can be implemented in combination with one another unless otherwise technically conflict with one another.

The grip portion 53*a* may be integrally provided with the supply portion 52.

The cover 17 may slide to be located at the closing position and the opening position. The container 26 may not contact the cover 17 located at the opening position. The liquid ejecting apparatus 11 may include, separately from the cover 17, a support that supports the container 26 in the engaged state.

The first guide 49 may have a desirable shape, such as a prism or an elliptic cylinder. The first guide 49 may be integrally formed with a side plate of the container 26. For example, the first guide 49 may be formed in a substantially semicircular cylinder so as to protrude inward from the side plate of the container 26. The container 26 may not include the first guide 49.

The engaging portion 59 may have an inclined portion inclined such that a portion near the leading end 26*a* is located at an upper position in the vertical direction Z. In this case, the engaged portion 42 may not have the inclined portion 61.

Regarding the container 26 in which the engaging portion 59 engages with the engaged portion 42 in the attachment posture, the first guide 49 and the grip portion 53*a* may be located in the attachment portion 27. By changing the posture of the container 26 while being kept in the engaged state, the first guide 49 and the grip portion 53*a* may be located on the outer side with respect to the attachment port 29.

When the container 26 in the attachment posture becomes the engaged state and when the first guide 49 and the grip portion 53*a* are located on the outer side with respect to the attachment port 29, the liquid container 25 may be replaced while the container 26 is kept in the attachment posture. The container 26 may not change the posture when the container 26 becomes the engaged state. The container 26 may change the posture in one of the width direction X and the vertical direction Z when the container 26 becomes the engaged state. That is, the container 26 and the attachment portion 27 may have the same size in the width direction X. The length of the engaged portion 42 in the attachment direction D1 may be equivalent to the length of the engaging portion 59 in the attachment direction D1.

The engaged portion 42 may be a protruding portion that protrudes to the movement path 38 of the container 26. The engaging portion 59 may be a recessed portion that is recessed upward in the vertical direction Z from the bottom surface of the container 26. At least one of the tip end of the protruding portion, the bottom surface of the recessed portion, and the side surfaces of the protruding shape and the recessed shape of the engaging portion 59 and the engaged portion 42 may be an arcuate shape, a hemispherical shape, or a sharp-pointed shape. Accordingly, the contact area between the engaging portion 59 and the engaged portion 42 can be decreased, and the container 26 can be more easily inclined.

The engaging portion 59 may have a circular cylinder or a circular column. The engaged portion 42 may be a hole having a diameter larger than the diameter of the engaging portion 59.

The engaged portion 42 may be constituted of a single member or a plurality of members. For example, the engaged portion 42 may be constituted of the exterior body 12 and the attachment portion 27.

The engaging portion 59 may engage with the engaged portion 42 in a state in which the second guide 30 and the rail 31 are engaged with each other.

In the vertical direction Z, the size at the leading end 26*a* of the container 26 may be the same as the size at the center 26*c*, or the size at the leading end 26*a* may be larger than the size at the trailing end 26*b* or the center 26*c*.

The liquid ejecting apparatus 11 may be a liquid ejecting apparatus that ejects or discharges a liquid other than an ink. The state of the liquid that is ejected in a form of a very small amount of a liquid droplet from the liquid ejecting apparatus includes a grain form, a tear form, or a string form having a tail. The liquid in this case may be any material as far as the liquid ejecting apparatus can eject the material. For example, the liquid may be in any form as far as the substance is in a liquid phase. The liquid includes fluid bodies, such as a liquid body having a high or low viscosity, a gel, a sol, gel water, an inorganic solvent, an organic solvent, a solvent, a liquid resin, a liquid metal, and a metal melt. The liquid is not limited to a liquid in one state of a substance, and includes one in which particles of a functional material constituted of a solid matter, such as a pigment or metal particles, are dissolved, dispersed, or mixed. A representative example of the liquid may be an ink which has been described in the embodiment, or a liquid crystal. In this case, the ink includes various types of typical liquid compositions, such as a water-based ink, an oil-based ink, a gel ink, and a hotmelt ink. A specific example of the liquid ejecting apparatus is an apparatus that ejects a liquid containing, in a dispersed form or a dissolved form, a material of an electrode material or a coloring material that is used for, for example, manufacturing a liquid crystal display, an electroluminescence display, a surface emitting display, or a color filter. The liquid ejecting apparatus may be an apparatus that ejects a living-body organic substance which is used for manufacturing biochips, an apparatus that ejects a liquid which is used for a precision pipet and serves as a sample, a textile printing apparatus, or a micro-dispenser. The liquid ejecting apparatus may be an apparatus that ejects a lubricating oil to a specific point of a precision machine, such as a watch or a camera, or an apparatus that ejects, onto a substrate, a transparent resin liquid such as an ultraviolet curable resin for forming a micro semispherical lens, an optical lens, or the like, which is used for an optical communication element or the like. The liquid ejecting apparatus may be an apparatus that ejects an etching liquid of an acid or an alkali for etching a substrate or the like.

Technical scopes and advantageous effects that are grasped from the above-described embodiment and modifications are described below.

A liquid ejecting apparatus includes a container on which a liquid container is removably mounted, the container having an engaging portion, the liquid container containing a liquid and having a grip portion that is gripped by a user; an attachment portion into which the container is inserted in an attachment direction from an attachment port and to which the container is attached; and a liquid ejecting head that ejects the liquid supplied from the liquid container mounted at the container. The attachment portion has an engaged portion that is engaged with the engaging portion of the container in a process of pulling out the container from the attachment portion. The container causes the grip portion to be located on an outer side with respect to the attachment port when the container is in an engaged state in which the engaging portion engages with the engaged portion and the engaging portion and the engaged portion are arranged next to each other in the attachment direction.

With the configuration, in the engaged state, since the engaging portion and the engaged portion are arranged next to each other in the attachment direction, a portion of the container is located in the attachment portion. The container in the engaged state causes the grip portion of the liquid container to be located on the outer side with respect to the attachment port. Accordingly, the user can grip the grip portion in a state in which the portion of the container is located in the attachment portion. Thus, the liquid container can be easily removed from the container.

In the liquid ejecting apparatus, the container may have a first guide that guides the liquid container when the liquid container is removed from the container; and in the engaged state, the first guide may be located on an outer side with respect to the attachment port.

With the configuration, when the container is in the engaged state, the first guide is located on the outer side with respect to the attachment port. Accordingly, the user can remove the liquid container while watching at the first guide. Thus, even when the container includes the first guide, the liquid container can be easily removed from the container.

In the liquid ejecting apparatus, the container is inserted into the attachment portion from a leading end of the container in the attachment direction; the engaging portion may be located nearer to the leading end of the container than a center of the container in the attachment direction; the engaged portion may be located nearer to the attachment port than the center of the container attached to the attachment portion; and in a state where the container is attached to the attachment portion, a size of the leading end of the container in a vertical direction is smaller than a size of a center of the container in a vertical direction.

With the configuration, the engaging portion is located nearer to the leading end than the center of the container, and the engaged portion is located nearer to the attachment port than the center of the container. The size of the container at the leading end is smaller than the size of the container at the center. Accordingly, the container can be inclined such that the trailing end opposite to the leading end moves in the vertical direction while being kept in the engaged state, and the liquid container can be more easily removed from the container.

In the liquid ejecting apparatus, a gap, in a width direction intersecting with the attachment direction and a vertical direction, may be provided between the attachment portion and the container attached to the attachment portion; the attachment portion may have a second guide that guides the container that is pulled out from the attachment portion; and the engaging portion may engage with the engaged portion after the guide by the second guide is removed.

With the configuration, the gap is provided between the attachment portion and the container attached to the attachment portion in the width direction. However, since the attachment portion has the second guide that guides the container, the container can be stably moved. After the guide of the container by the second guide is removed, the engaging portion engages with the engaged portion. Accordingly, when the container is in the engaged state, the second guide does not guide the container. Since the gap is provided between the container and the attachment portion, the container can be inclined such that the trailing end opposite to the leading end moves in the width direction while being kept in the engaged state, and the liquid container can be further easily removed from the container.

In the liquid ejecting apparatus, the engaged portion may be a recessed portion recessed in a vertical direction and provided in a movement path of the container that is pulled out from the attachment portion; and the engaging portion may be a protruding portion that engages with the engaged portion in a process of pulling out the container from the attachment portion.

With the configuration, the engaged portion is the recessed portion recessed in the vertical direction. Accordingly, since the engaging portion falls into the engaged portion and engages with the engaged portion, the gap located at the upper position in the vertical direction between the attachment portion and the container in the engaged state increases. Thus, when the container is in the engaged state, the trailing end to be pulled out first can be easily inclined so as to be located at the position lower than the leading end in the vertical direction.

In the liquid ejecting apparatus, a gap, in a width direction intersecting with the attachment direction and a vertical direction, may be provided between the attachment portion and the container attached to the attachment portion; and a length of the engaged portion in the attachment direction may be larger than a length of the engaging portion in the attachment direction.

With the configuration, the length of the engaged portion, which is the recessed portion, in the attachment direction is larger than the length of the engaging portion, which is the protruding portion, in the attachment direction. Since the gap is provided between the container and the attachment portion in the width direction, the container can be inclined such that the trailing end opposite to the leading end moves in the width direction while being kept in the engaged state, and the liquid container can be further easily removed from the container.

In the liquid ejecting apparatus, a surface located on a deep side in the attachment direction among surfaces constituting the engaged portion may have an inclined portion inclined downward from the deep side toward the attachment port.

With the configuration, the surface located on the deep side of the engaged portion has the inclined portion inclined downward from the deep side toward the attachment port. Accordingly, when the container attached to the attachment portion is pulled out, the engaging portion is led by the engaged portion along the inclined portion, and the engaging portion can smoothly engage with the engaged portion.

In the liquid ejecting apparatus, the engaged portion may be arranged next to the attachment port in the attachment direction; the container may have a first guide that guides the liquid container when the liquid container is removed from the container, and the container is inserted into the attachment portion from a leading end of the container in the attachment direction; and the engaging portion may be located between the leading end and the first guide in the attachment direction.

With the configuration, the engaged portion is arranged next to the attachment port in the attachment direction, and the engaging portion is located between the leading end and the first guide. Thus, when the container is in the engaged state, the first guide can be easily located on the outer side with respect to the attachment port.

The liquid ejecting apparatus may further include a cover that is located at a closing position and an opening position, the cover covering the attachment port at the closing position, the cover exposing the attachment port at the opening position. The container in the engaged state may contact the cover located at the opening position.

With the configuration, the container in the engaged state contacts the cover at the opening position. That is, since the container is supported by the engaged portion and the cover, the posture of the container can be stable.

What is claimed is:

1. A liquid ejecting apparatus comprising:

a container on which a liquid container is removably mounted, the container having an engaging portion, the liquid container containing a liquid and having a grip portion that is gripped by a user;

an attachment portion into which the container is inserted in an attachment direction from an attachment port and to which the container is attached; and a liquid ejecting head that ejects the liquid supplied from the liquid container mounted at the container, wherein the attachment portion has an engaged portion that is engaged with the engaging portion of the container in a process of pulling out the container from the attachment portion, and wherein the engaged portion is arranged next to the attachment port in the attachment direction, wherein the container has a first guide that guides the liquid container when the liquid container is removed from the container, and the container is inserted into the attachment portion from a leading end of the container in the attachment direction, wherein the first guide is provided at a position between a center of the container and the leading end in the attachment direction, wherein the engaging portion is located between the leading end and the first guide in the attachment direction, and wherein in an engaged state in which the engaging portion engages with the engaged portion and the engaging portion and the engaged portion are arranged next to each other in the attachment direction, the first guide is located on an outer side with respect to the attachment port.

2. The liquid ejecting apparatus according to claim 1, wherein the container is inserted into the attachment portion from the leading end of the container in the attachment direction, the engaging portion is located nearer to the leading end of the container than a center of the container in the attachment direction, the engaged portion is located nearer to the attachment port than the center of the container attached to the attachment portion, and in a state where the container is attached to the attachment portion, a size of the leading end of the container in a vertical direction is smaller than a size of a center of the container in a vertical direction.

3. The liquid ejecting apparatus according to claim 1, wherein a gap, in a width direction intersecting with the attachment direction and a vertical direction, is provided between the attachment portion and the container attached to the attachment portion, the attachment portion has a second guide that guides the container that is pulled out from the attachment portion, and the engaging portion engages with the engaged portion after guidance of the container by the second guide is completed.

4. The liquid ejecting apparatus according to claim 1, wherein the engaged portion is a recessed portion recessed in a vertical direction and provided in a movement path of the container that is pulled out from the attachment portion, and the engaging portion is a protruding portion that engages with the engaged portion in a process of pulling out the container from the attachment portion.

5. The liquid ejecting apparatus according to claim 4, wherein a gap, in a width direction intersecting with the attachment direction and a vertical direction, is provided between the attachment portion and the container attached to the attachment portion, and a length of the engaged portion in the attachment direction is larger than a length of the engaging portion in the attachment direction.

6. The liquid ejecting apparatus according to claim 4, wherein a surface located on a deep side in the attachment direction among surfaces constituting the engaged portion has an inclined portion inclined downward from the deep side toward the attachment port.

7. A liquid ejecting apparatus comprising:

a container on which a liquid container is removably mounted, the container having an engaging portion, the liquid container containing a liquid and having a grip portion that is gripped by a user;

an attachment portion into which the container is inserted in an attachment direction from an attachment port and to which the container is attached;

a liquid ejecting head that ejects the liquid supplied from the liquid container mounted at the container; and a cover that is located at a closing position and an opening position, the cover covering the attachment port at the closing position, the cover exposing the attachment port at the opening position, wherein the attachment portion has an engaged portion that is engaged with the engaging portion of the container in a process of pulling out the container from the attachment portion, and wherein the container causes the grip portion to be located on an outer side with respect to the attachment port when the container is in an engaged state in which the engaging portion engages with the engaged portion and the engaging portion and the engaged portion are arranged next to each other in the attachment direction, and wherein the container in the engaged state is configured to contact the cover located at the opening position.

8. A liquid ejecting apparatus comprising:

a plurality of attachment portions into which a plurality of liquid containing portions are respectively inserted in an attachment direction from an attachment port, the plurality of attachment portion being provided side by side in a vertical direction; and a liquid ejecting head that ejects the liquid supplied from the liquid containing portion, wherein, of the plurality of attachment portions, the attachment portion excluding the attachment portion arranged at a bottom has an engaged portion, wherein the engaged portion is engaged with the engaging portion of the liquid containing portion in a process of pulling out the liquid containing portion from the attachment portion.

9. The liquid ejecting apparatus according to claim 8, wherein the liquid containing portion include a liquid container containing a liquid and a container on which the liquid container is removably mounted, the container having the engaged portion, the liquid container having a grip portion that is gripped by a user, wherein the container causes the grip portion to be located on an outer side with respect to the attachment port when the container is in an engaged state in which the engaging portion engages with the engaged portion and the engaging portion, and the engaged portion are arranged next to each other in the attachment direction.

10. The liquid ejecting apparatus according to claim 8, wherein the liquid containing portion include a liquid container containing a liquid and a container on which the liquid container is removably mounted, the container having the engaged portion, wherein the engaged portion is arranged next to the attachment port in the attachment direction, wherein the container has a first guide that guides the liquid container when the liquid container is removed from the container, and the container is inserted into the attachment portion from a leading end of the container in the attachment direction, and wherein the engaging portion is located between the leading end and the first guide in the attachment direction.

* * * * *